US005400632A

United States Patent [19]

Castellani

[11] Patent Number: 5,400,632

[45] Date of Patent: Mar. 28, 1995

[54] DEMOUNTABLE ROLLING STAND

[75] Inventor: Federico Castellani, Tarcento, Italy

[73] Assignee: S.I.M.A.C. S.P.A., Tarcento, Italy

[21] Appl. No.: 793,642

[22] Filed: Nov. 18, 1991

[30] Foreign Application Priority Data

Dec. 12, 1990 [IT] Italy ..... 60471/90 U

[51] Int. Cl.[6] ..... B21B 31/07; B21B 31/26

[52] U.S. Cl. ..... 72/238; 72/248

[58] Field of Search ..... 72/237, 238, 225, 245, 72/248

[56] References Cited

U.S. PATENT DOCUMENTS

| | | | |
|---|---|---|---|
| 4,715,206 | 12/1987 | Forni | 72/237 |
| 4,905,493 | 3/1990 | Benedetti | 72/238 |
| 4,924,689 | 5/1990 | Wilson | 72/238 |
| 4,969,347 | 11/1990 | Matsuo et al. | 72/248 |

FOREIGN PATENT DOCUMENTS

| | | | |
|---|---|---|---|
| 0065935 | 12/1982 | European Pat. Off. | 72/238 |
| 0227628 | 9/1985 | Germany | 72/235 |

*Primary Examiner*—Lowell A. Larson
*Assistant Examiner*—Thomas C. Schoeffler
*Attorney, Agent, or Firm*—Harrison & Egbert

[57] ABSTRACT

A demountable rolling stand having a support base, a pair of rolling cylinders with necks formed thereon, two side structures for supporting the rolling cylinders laterally therebetween, at least two pairs of pretensioning tie-rods engaging the side structures so as to clamp the side structures to the cylinders. The side structures have cylindrical support roll bearings affixed thereto in support of the rolling cylinders. The necks of the rolling cylinders have an interior ring of the cylindrical support roll bearings affixed directly thereto such that the interior ring is removable along with the rolling cylinders. The support base is connected to the side structures so as to support the cylinders above a surface. The pretensioning tie-rods serve to pretension a rolling force between the cylinders.

4 Claims, 6 Drawing Sheets

DEMOUNTABLE ROLLING STAND

TECHNICAL FIELD

The present invention relates to demountable rolling stands.

BACKGROUND ART

Demountable and adjustable rolling stands are known to be installed vertically or horizontally. Universal rolling stands are also known in the prior art.

These rolling stands cause a great many difficulties when disassembled. These stands are disassembled when it is necessary to carry out maintenance activities or to change the cylinders.

Another problem with such demountable and adjustable rolling stands is the concern for the gasket support systems of the cylinders, These gasket support systems involve a great deal of problems of sizing the necks of the cylinders to the size of the installed bearings.

It is also important for such rolling stands to provide for the pre-tensioning of the clamping forces between the cylinders in order to avoid the loosening of the cylinders when they are moved out of position., This also serves to avoid deformation of the rolling cylinder.

One of the problems that occurs when the cylinders get loose during movement is that they freely oscillate. It is important to avoid deformation of the respective support surfaces, particularly in the coupling of the spacers, so as to avoid variations in bearing loads.

SUMMARY OF THE INVENTION

These and other features are realized with the present invention by means of a demountable rolling stand. The demountable rolling stand for the present invention comprises at least one pair of rolling cylinders adjustable in the rolling wheelbase and axially adjustable. The demountable rolling stand of the present invention comprises a support base, at least one pair of rolling cylinders with necks that mount within respective cylindrical roll bearings, two side structures for lateral support of the removable cylinders, and two pairs of pretensioning tie-rods so as to clamp the side structures to the cylinder and to the base in a properly pretensioned state. Each of the cylinders has necks formed thereon. These necks are affixed to the respective interior rings of the cylinder roll support bearings. When the cylinders are removed from the bearings, this interior ring remains attached to the neck of the cylinder.

The configuration of the present invention provides many advantages. First, the present invention reduces the fabrication costs associated with the precise machining and manufacture of the rolling stand. The present invention also improves the operating efficiency of the machine. The arrangement of the present invention greatly enhances the loading capacity of the stand. The present invention allows the diameter of the neck of the cylinders to be strengthened by the use of the interior rings, The present invention further reduces maintenance costs and dangers of crashes and deformations. The present invention is also adaptable for use as a universal rolling stand.

The axial alignment of the cylinders is created by an endless screw adjustment system. This employs a single transverse adjustment axle mounted on one of the two side structures. Through the use of this arrangement, the disassembly of the stand can be more easily accomplished, The rolling span (the variation of the wheelbase) occurs by means of a rotation system of eccentric members through a unique adjustable axle arrangement unconnected between the two side structures.

The arrangement of the present invention greatly simplifies the structural arrangement of the rolling stand. The structure of the present invention is prearranged for the insertion of another pair of orthogonal cylinders so as to allow the present invention to be adapted to become a universal rolling stand.

These and other objects and advantages of the present invention will become apparent from a reading of the attached specification and appended claims.

DETAILED DESCRIPTION OF THE INVENTION

Figure 1:
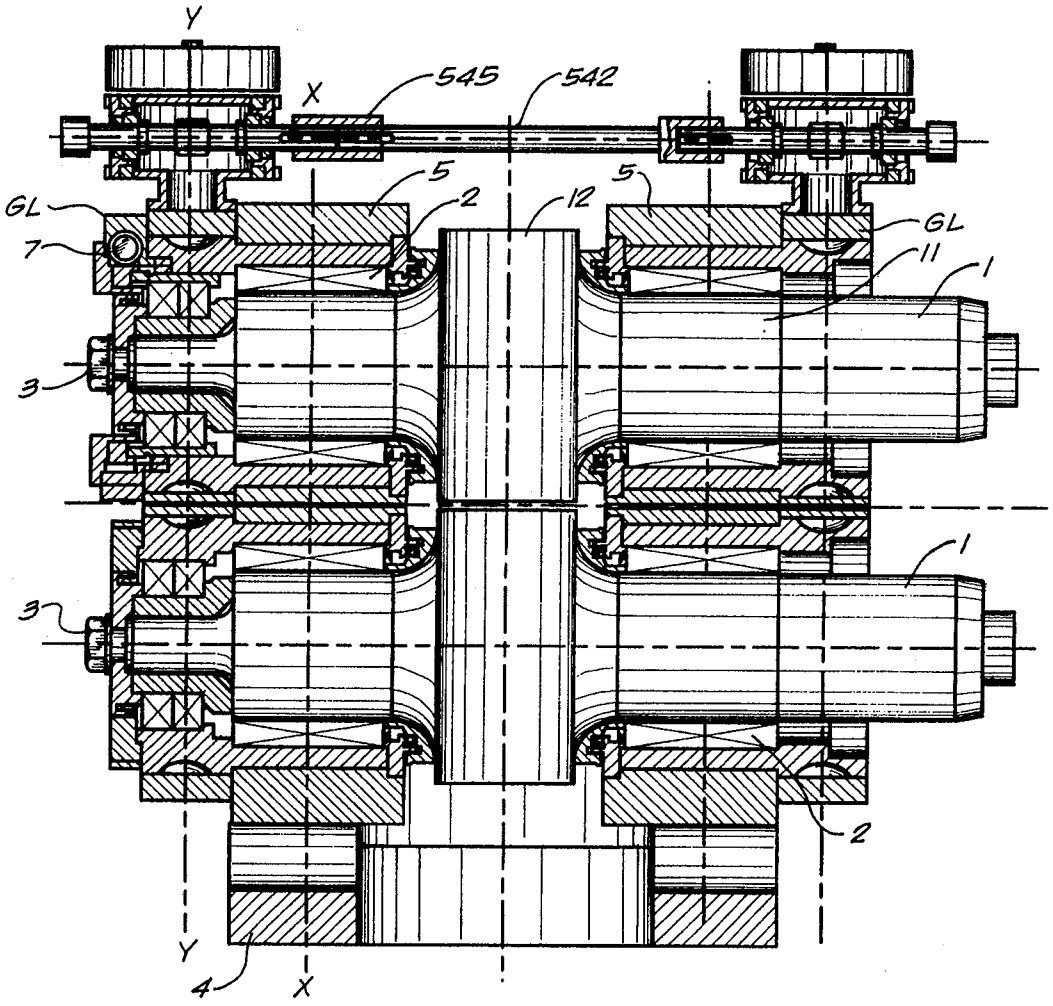
FIG. 1 shows a partial view of a conveying plane according to the invention, in section on an orthogonal vertical plane relative to the longitudinal line of the advancement of the cylinders.
Figure 1A:
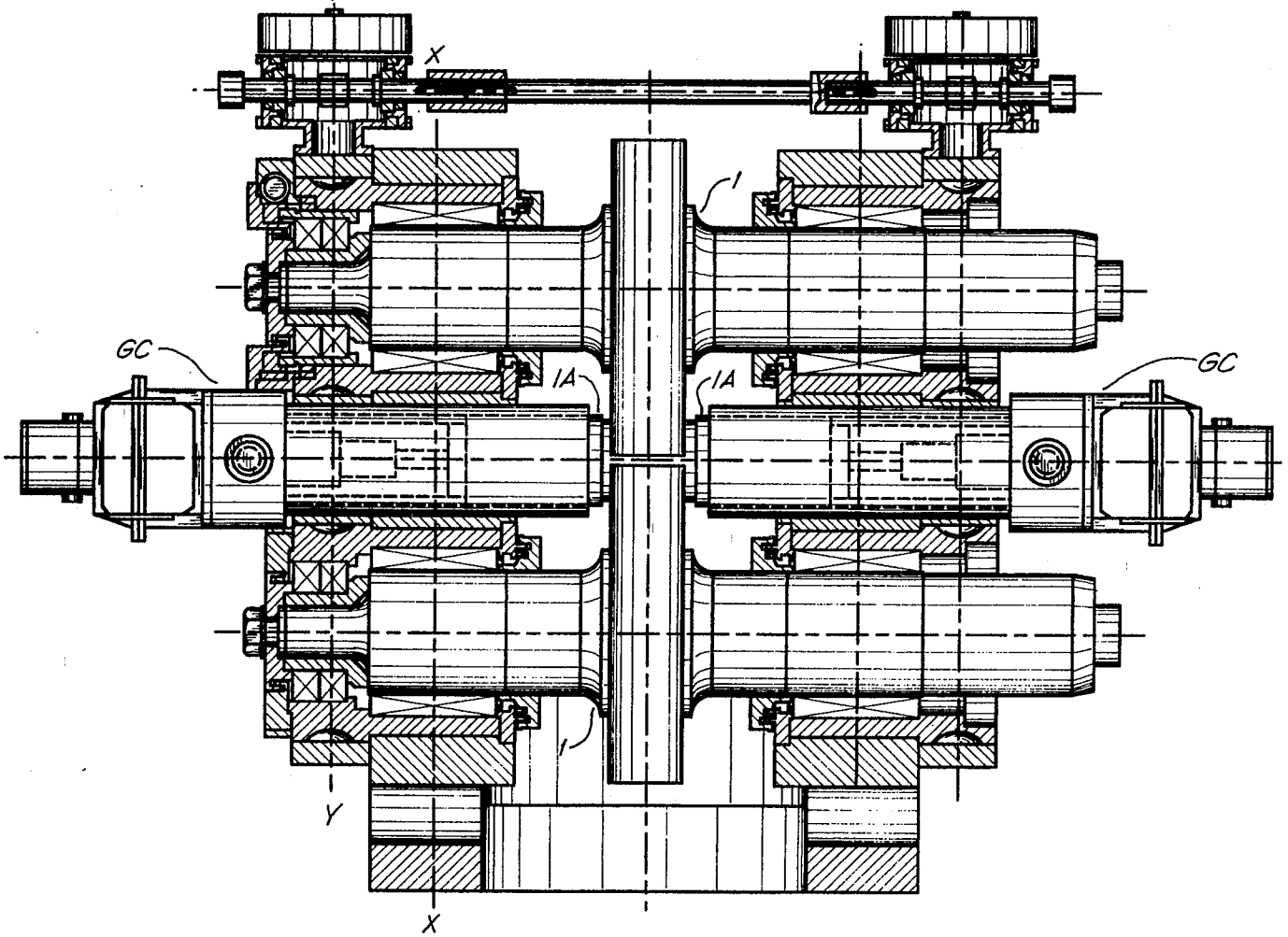
FIG. 1A represents a sectional view for a universal rolling stand in accordance with the present invention.
Figure 2:
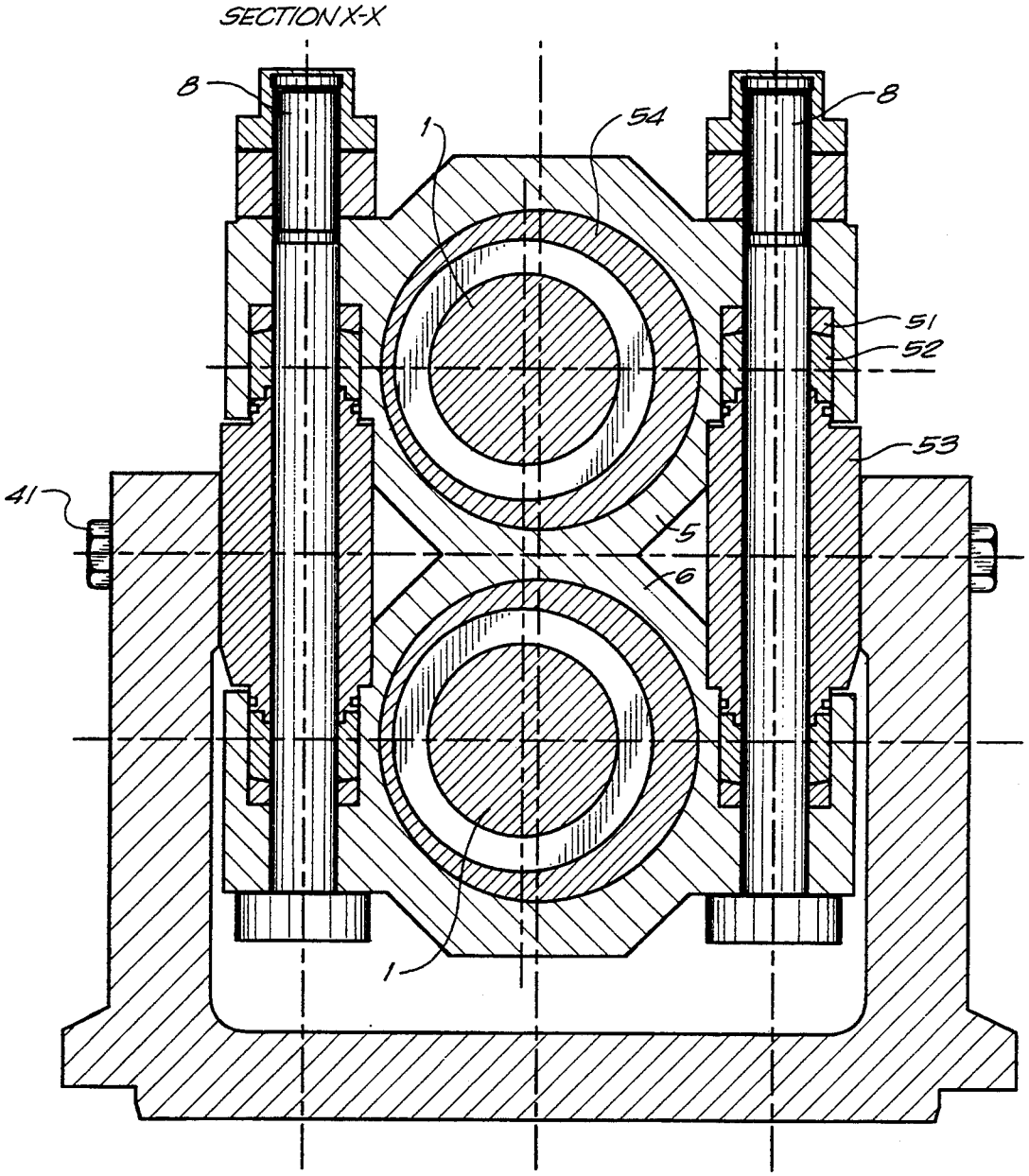
FIG. 2 is a cross-sectional view in accordance with plane X—X of FIG. 1.
Figure 3:
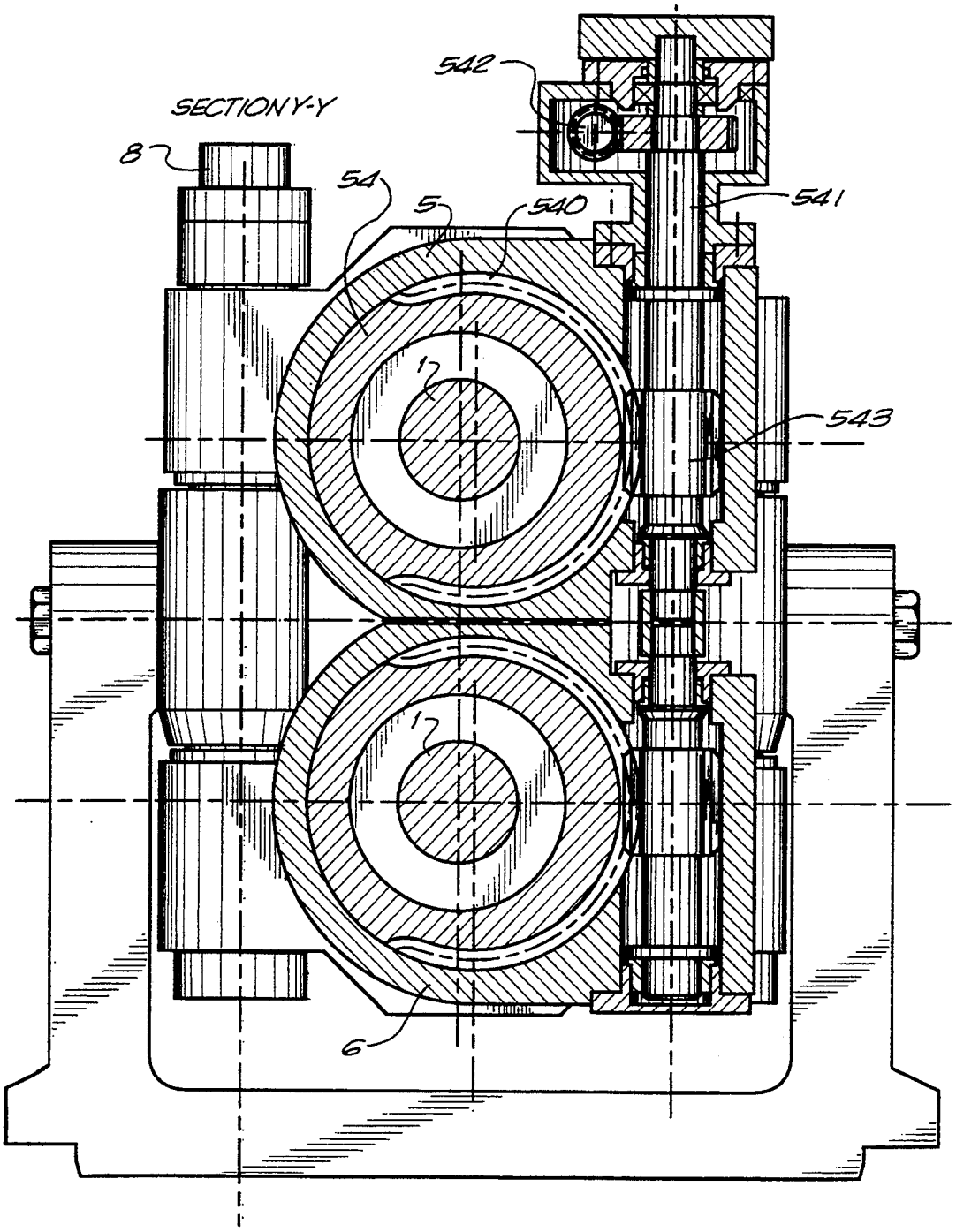
FIG. 3 is a cross-sectional view in accordance with the plane Y—Y of FIG. 1.
Figure 3A:
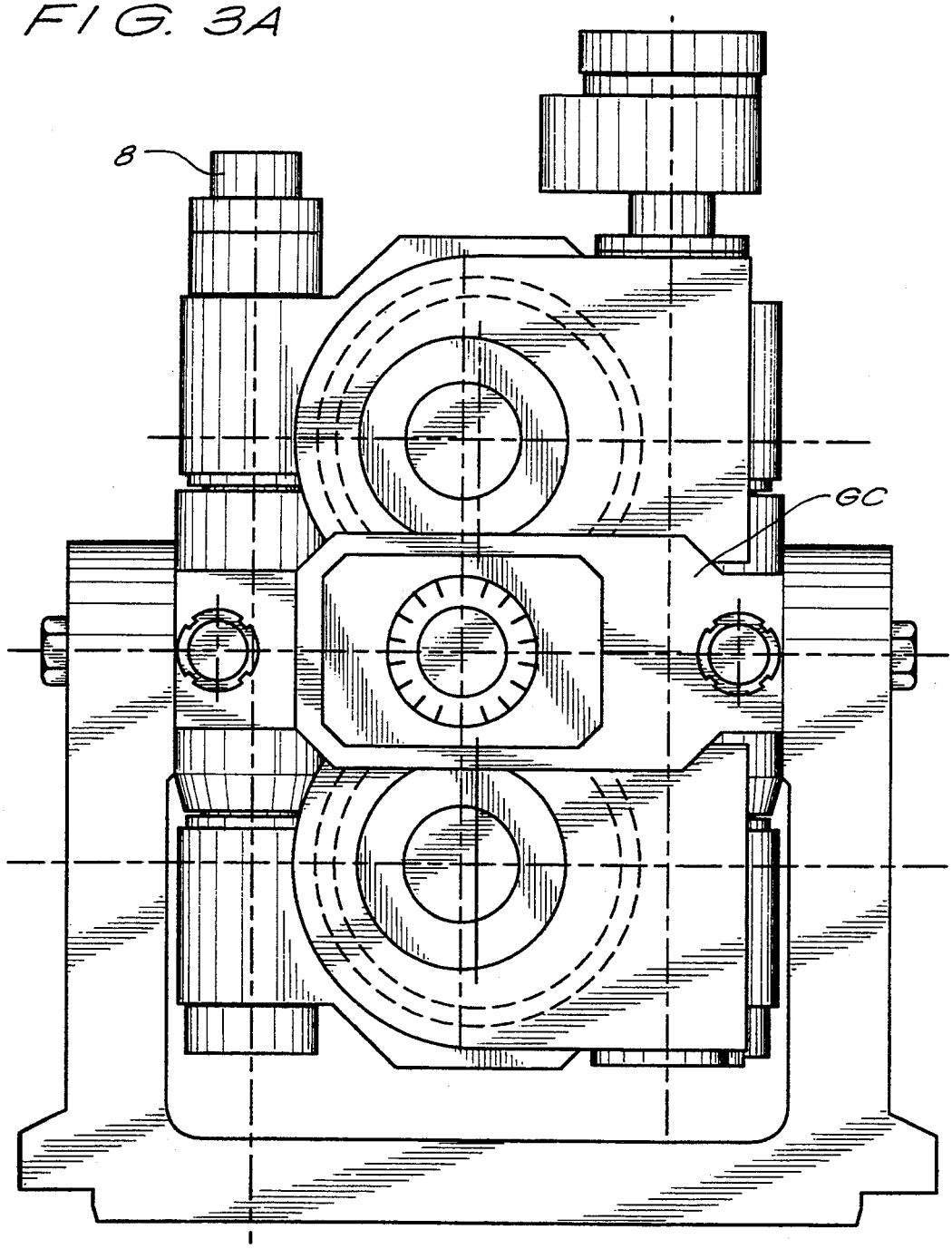
FIG. 3A represents a side view of the universal rolling stand in accordance with the present invention.
Figure 4:
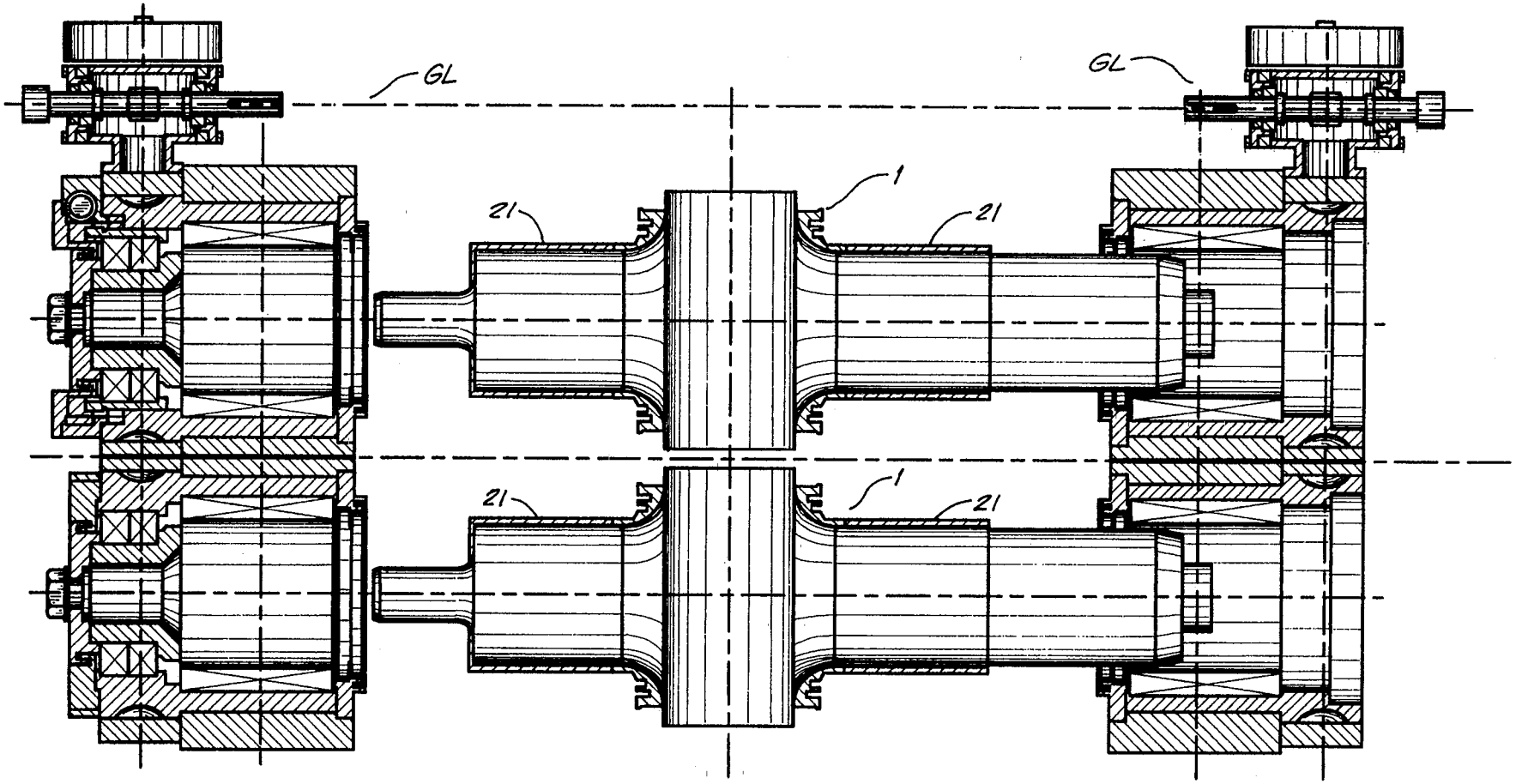
FIG. 4 shows an exploded view of the disassembled rolling stand in cross-section as passing through the axis of the cylinders.

The rolling stand of the present invention is a demountable type of stand. The present invention has at least one pair of rolling cylinders (1, 1') adjustable in the direction of the rolling wheelbase and axially adjustable. This stand includes a support base (4), at least one pair of rolling cylinders (1) having necks which are received within respective cylindrical bearings mounted thereon, two side structures for lateral cylinder support (GN) for removably supporting the cylinders in a desired position above the support base, and two pairs of pretensioning tie rods (8) to clamp the side structures (GL) to the cylinders (1, 1') above the base in a desired state of pretensioning. An interior ring (21) of the cylindrical support bearings (2) is affixed to the necks (11) of the cylinders (1). The cylinders (1) extend laterally between the side structures (GL).

The axial alignment of the cylinders takes place by means of an endless screw adjustment system (7). The rolling span (wheelbase variation) of the cylinders takes place by means of the eccentric rotation system (54) by means of two vertical regulation axles (541) mounted on the respective side structures (GL) connected by a single cross axle arrangement (542, 545). The transmission takes place by gearing (543) with a toothed portion (540) connected to the cylinder (1). These items are incorporated into the independent support sealing members (5, 6).

The structure of the present invention is prearranged for the insertion of a pair of orthogonal cylinders so as to make it possible that the present invention can be used as a universal stand.

The pretensioning tie rods (8) interact with the respective sealing members (5, 6) through the use of central spacers (53) and outer spacers (51, 52). These spacers are coupled to the spherical surface so as to allow oscillations due to the flexure of the cylinders (1).

The stand of the present invention can be arranged so as to operate into both a horizontal position and a vertical position.

By substituting the central spacer (53) for a spacer of greater length, one can insert another pair of orthogonal cylinders (1A) so as to allow for the formation of a universal stand. The adaptation of the present invention into a universal stand includes the addition of only two cylindrical rolling opposite orthogonal groups (GC). This is accomplished while the structural system, its adjustment, assembly and disassembly remains the same.

I claim:

1. A demountable rolling stand comprising:

a support base;

at least a pair of rolling cylinders having necks formed thereon;

two side structures for supporting said rolling cylinders laterally therebetween, said rolling cylinders removably received within said side structures, said side structures having cylindrical support roll bearings affixed thereto in support of said rolling cylinders, said necks for said rolling cylinders each having an interior ring of said cylindrical support roll bearings affixed directly thereto such that said interior rings are removable along with each of said rolling cylinders and separable from said cylindrical support roll bearings;

at least two pairs of pretensioning tie-rods engaging said side structures so as to clamp said side structures to said cylinders, said support base connected to said side structures so as to support said cylinders above a surface, said pretensioning tie-rods for pretensioning a rolling force between the cylinders; and eccentric rotation means positioned over said necks of said cylinders, said eccentric rotation means for adjusting a distance between said cylinders independently of said pretensioning tie-rods.

2. The stand of claim 1, said eccentric rotation means having two vertically adjustable axles mounted on said side structures, said adjustable axles interconnected by a single cross axle.

3. The stand of claim 1, said eccentric rotation means comprising a drive system in geared relationship with at least one of said cylinders.

4. The stand of claim 1, said pretensioning tie-rods having a plurality of spacers positioned thereon, said spacers for fixing a distance between said cylinders.

* * * * *